US012195239B2

(12) United States Patent
Gull

(10) Patent No.: US 12,195,239 B2
(45) Date of Patent: Jan. 14, 2025

(54) UPRIGHT SUPPORT BASE

(71) Applicant: Zarsone Inc., San Diego, CA (US)

(72) Inventor: Zarghona Gull, San Diego, CA (US)

( * ) Notice: Subject to any disclaimer, the term of this patent is extended or adjusted under 35 U.S.C. 154(b) by 0 days.

(21) Appl. No.: 17/560,670

(22) Filed: Dec. 23, 2021

(65) Prior Publication Data

US 2022/0194665 A1 Jun. 23, 2022

Related U.S. Application Data

(60) Provisional application No. 63/129,791, filed on Dec. 23, 2020.

(51) Int. Cl.
*B65D 33/02* (2006.01)
*B65D 81/02* (2006.01)

(52) U.S. Cl.
CPC ..... *B65D 33/02* (2013.01); *B65D 81/02* (2013.01)

(58) Field of Classification Search
CPC .... B65D 81/02; B65D 81/022; B65D 81/051; B65D 33/02
See application file for complete search history.

(56) References Cited

U.S. PATENT DOCUMENTS 3,028,702 A * 4/1962 Napoleon ..... A47G 23/0216 220/630
4,346,895 A * 8/1982 Brownlee ..... A63F 1/10 248/910
4,788,916 A * 12/1988 Saxton ..... A47G 23/0608 248/910
5,288,150 A 2/1994 Bearman
5,570,588 A 11/1996 Lowe
5,732,849 A * 3/1998 Brooks ..... A47B 23/002 220/17.1
5,924,661 A * 7/1999 Chernack ..... A47C 7/008 248/188.2
6,041,715 A * 3/2000 Jarke ..... A47B 23/002 5/639
6,581,888 B1 * 6/2003 Castillo ..... A47G 23/0225 248/910
6,843,458 B1 * 1/2005 Robinson ..... A47G 23/0216 248/314
6,986,308 B1 * 1/2006 King ..... A47G 23/0608 108/43
7,080,810 B2 * 7/2006 Munjed ..... A61J 9/0669 248/102
7,568,362 B2 8/2009 Das
7,988,106 B2 * 8/2011 Carnevali ..... F16M 11/041 248/910

(Continued)

OTHER PUBLICATIONS

Kim "International Search Report for International Application No. PCT/US2021/065062" mailed on Mar. 9, 2022, 2 pages.

(Continued)

*Primary Examiner* — Derek J Battisti
(74) *Attorney, Agent, or Firm* — Intellectual Strategies

(57) ABSTRACT

A support and stabilization base includes an outer casing, a compartment within the outer casing, and a flowing substance within the compartment, flowing substance deforms when acted upon by an external force. The outer casing is constructed of a pliable material or combination of materials. The bottom of the outer casing is configured to conform to a surface.

10 Claims, 5 Drawing Sheets

(56) References Cited

U.S. PATENT DOCUMENTS

| | | | | |
|---|---|---|---|---|
| 8,167,131 | B1 * | 5/2012 | Anderson | A45F 3/02 190/102 |
| 2010/0147861 | A1 * | 6/2010 | Andochick | B60N 3/002 220/694 |

OTHER PUBLICATIONS

Kim "Written Opinion of the International Searching Authority for International Application No. PCT/US2021/065062" mailed on Mar. 9, 2022, 5 pages.

* cited by examiner

UPRIGHT SUPPORT BASE

CROSS-REFERENCE TO RELATED APPLICATIONS

This application claims the benefit of U.S. Provisional Application No. 63/129,791, filed on Dec. 23, 2020, which is incorporated by reference herein in its entirety.

FIELD

This invention relates to an upright support base. More particularly, embodiments of the invention relate to an upright support base that may be used for a carrier for transporting, holding, and supporting items. Embodiments of the invention relate to supporting and stabilizing items that are placed on uneven surfaces or sloped surfaces, especially while in transit or in situations where stability may be compromised.

BACKGROUND

The need for transporting items is increasing. Delivery of items to homes is increasing as persons order more of their food and personal items online and have those items delivered to their house. In addition, transporting items from a store or restaurant may be necessary. Many items that are transported need to remain upright no matter the surface that they are set upon. This is especially true of food and beverage items. Additionally, the most convenient surfaces on which to rest these items may be a non-level surface (such as a passenger seat of a car). Setting the items on the passenger seat, which may be sloped, may increase the chance of spilling the items. Conventional carriers are not equipped to efficiently solve this problem. Embodiments described herein include improved upright carriers that are configured to remain upright.

Embodiments of the present invention allow for supporting and stabilizing items that are placed on uneven surfaces or sloped surfaces, especially while in transit or in situations where stability may be compromised. Other aspects and advantages of embodiments of the present invention will become apparent from the following detailed description, taken in conjunction with the accompanying drawings, illustrated by way of example of the principles of the invention.

SUMMARY

The subject matter of the present application has been developed in response to the present state of the art, and in particular, in response to the problems and disadvantages associated with conventional systems that have not yet been fully solved by currently available techniques. Accordingly, the subject matter of the present application has been developed to provide embodiments that overcome at least some of the shortcomings of prior art techniques.

A support and stabilization base includes an outer casing, a compartment within the outer casing, and a flowing substance within the compartment, wherein the flowing substance deforms when acted upon by an external force. The outer casing is constructed of a pliable material or combination of materials. The bottom of the outer casing is configured to conform to a surface. The preceding subject matter of this paragraph characterizes example 1 of the present disclosure.

The base further includes a receptacle. The receptacle is coupled to the outer casing. The receptacle is configured to hold at least one object within the receptacle. The preceding subject matter of this paragraph characterizes example 2 of the present disclosure, wherein example 2 also includes the subject matter according to example 1, above.

The outer casing is coupled to an inside of the receptacle. The preceding subject matter of this paragraph characterizes example 3 of the present disclosure, wherein example 3 also includes the subject matter according to any one of examples 1-2, above.

The outer casing is coupled to a bottom surface of the receptacle. The preceding subject matter of this paragraph characterizes example 4 of the present disclosure, wherein example 4 also includes the subject matter according to any one of examples 1-3, above.

The receptacle is one of a flexible bag, a drink carrier, or a tray. The preceding subject matter of this paragraph characterizes example 5 of the present disclosure, wherein example 5 also includes the subject matter according to any one of examples 1-4, above.

The outer casing is further configured to conform on a bottom of the outer casing to a surface on which the base may rest. The preceding subject matter of this paragraph characterizes example 6 of the present disclosure, wherein example 6 also includes the subject matter according to any one of examples 1-5, above.

The flowing substance is one of granules, ovoid-shaped granular stuffing, a gel substance, or sand. The preceding subject matter of this paragraph characterizes example 7 of the present disclosure, wherein example 7 also includes the subject matter according to any one of examples 1-6, above.

The flowing substance is granules. The granules include pellets of a hard material and are configured to shift and move relative to each other. The preceding subject matter of this paragraph characterizes example 8 of the present disclosure, wherein example 8 also includes the subject matter according to any one of examples 1-7, above.

The flowing substance includes viscoplastic materials. The preceding subject matter of this paragraph characterizes example 9 of the present disclosure, wherein example 9 also includes the subject matter according to any one of examples 1-8, above.

The base further includes a rigid board within a second compartment of the outer casing. The preceding subject matter of this paragraph characterizes example 10 of the present disclosure, wherein example 10 also includes the subject matter according to any one of examples 1-9, above.

The surface is an uneven surface. The preceding subject matter of this paragraph characterizes example 11 of the present disclosure, wherein example 11 also includes the subject matter according to any one of examples 1-10, above.

A support and stabilization base includes a flowing substance housed within a bag, a rigid board, and an outer casing. The bag and the rigid board are housed within the outer casing. The rigid board is positioned at a top of the outer casing and above the bag which is position at a bottom of the outer casing. The outer casing is constructed of a pliable material. A top of the base is substantially flat and a bottom of the base is pliable and configured to conform to an uneven surface. The preceding subject matter of this paragraph characterizes example 12 of the present disclosure.

The base further includes a receptacle. The receptacle is coupled to the outer casing. The receptacle is configured to hold at least one object within or on top of the receptacle.

The preceding subject matter of this paragraph characterizes example 13 of the present disclosure, wherein example 13 also includes the subject matter according to example 12, above.

The outer casing is lined within an inside of the receptacle. The preceding subject matter of this paragraph characterizes example 14 of the present disclosure, wherein example 14 also includes the subject matter according to any one of examples 12-13, above.

The outer casing is coupled to a bottom surface of the receptacle. The preceding subject matter of this paragraph characterizes example 15 of the present disclosure, wherein example 15 also includes the subject matter according to any one of examples 12-14, above.

The bag and the rigid board are separated by a fabric liner within the outer casing. The preceding subject matter of this paragraph characterizes example 16 of the present disclosure, wherein example 16 also includes the subject matter according to any one of examples 12-15, above.

The receptacle is one of a flexible bag, a drink carrier, or a tray. The preceding subject matter of this paragraph characterizes example 17 of the present disclosure, wherein example 17 also includes the subject matter according to any one of examples 12-16, above.

The flowing substance includes granules. The granules include ovoid-shaped granular stuffing. The preceding subject matter of this paragraph characterizes example 18 of the present disclosure, wherein example 18 also includes the subject matter according to any one of examples 12-17, above.

The flowing substance includes granules. The granules include pellets of a hard material and are configured to shift and move relative to each other. The preceding subject matter of this paragraph characterizes example 19 of the present disclosure, wherein example 19 also includes the subject matter according to any one of examples 12-18, above.

The flowing substance is one of granules, ovoid-shaped granular stuffing, a gel substance, or sand. The preceding subject matter of this paragraph characterizes example 20 of the present disclosure, wherein example 20 also includes the subject matter according to any one of examples 12-19, above.

Other aspects and advantages of embodiments of the present invention will become apparent from the following detailed description, taken in conjunction with the accompanying drawings, illustrated by way of example of the principles of the invention.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

Throughout the description, similar reference numbers may be used to identify similar elements.

DETAILED DESCRIPTION

Figure 1:
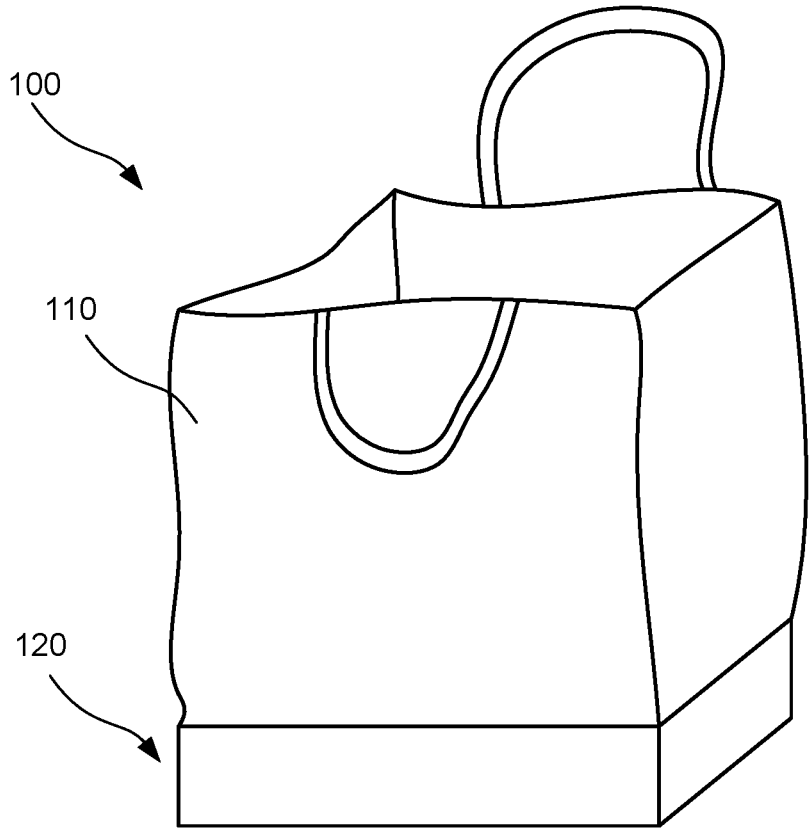
FIG. 1 depicts an isometric view illustrating an upright bag and support and stabilization base in accordance with one or more embodiments of the present disclosure.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment of the present invention. Thus, the phrases "in one embodiment," "in an embodiment," and similar language throughout this specification may, but do not necessarily, all refer to the same embodiment.

This disclosure describes an example of a support and stabilization base. In some embodiments, the support and stabilization base may be utilized in conjunction with a receptacle. Receptacle refers to an item capable of carrying an object or other substance. Examples used herein include a fabric bag, a sack, drink carrier, a water bowl, or any other carrying device that one wishes to have a stable and relatively flat surface to be set upon. The support and stabilization base acts as stable and relatively flat surface to allow for the receptacle or other item to upon. The support and stabilization base transforms uneven or sloped surfaces into flat and/or level surfaces.

In some embodiments, the receptacle may be coupled to the support and stabilization base. In other embodiments, the receptacle or other item may wholly and completely separate from the support and stabilization base. The support and stabilization base acts as a flat and stable surface for the item or receptacle.

Figure 2:
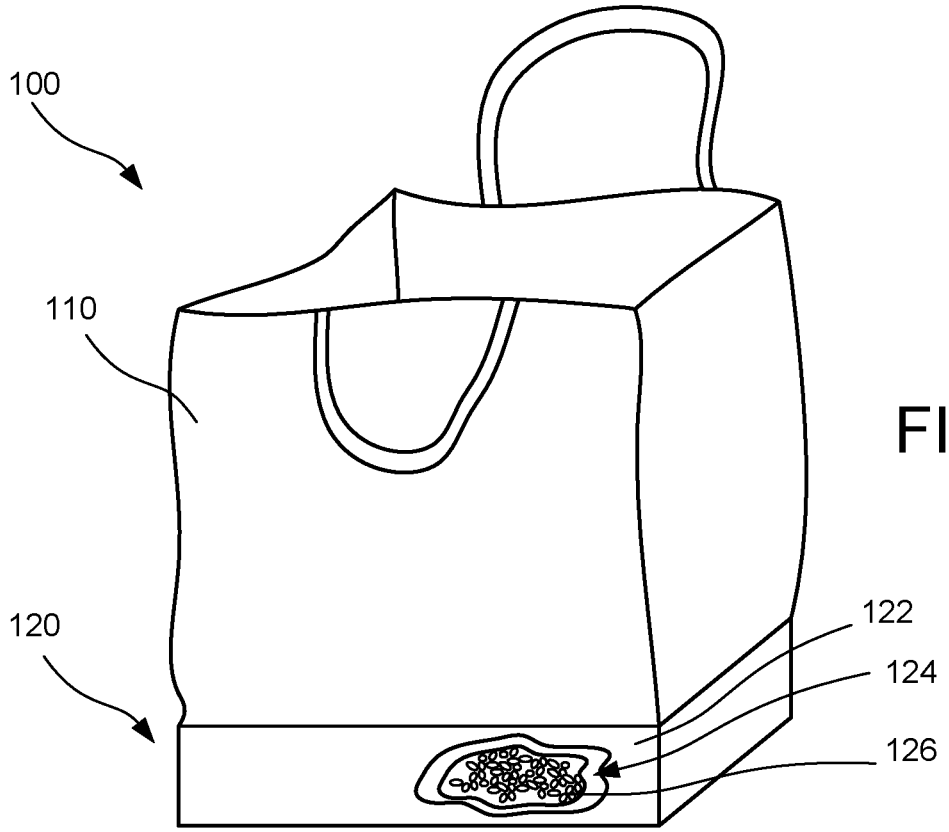
FIG. 2 depicts an isometric view illustrating the upright bag and support and stabilization base with an opening to be able to view the internal components of the base in accordance with one or more embodiments of the present disclosure.

Referring to FIG. 1, an embodiment of a carrier device 100 designed to remain upright is shown. Although shown and described with certain components and functionality, other embodiments may include fewer or more components to implement less or more functionality. The carrier device 100 includes a receptacle 110 and a base 120, also referred to as a support and stabilization base herein. FIG. 2 includes a view of the carrier device 100 with a portion of the outer casing 122 removed showing some of the internal components of the base.

Figure 10:
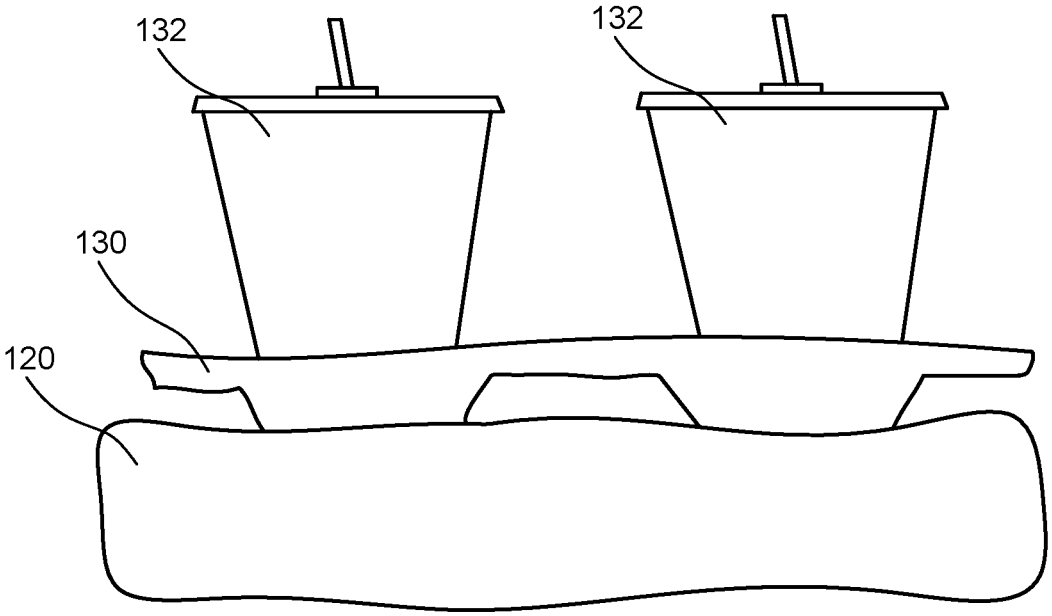
FIG. 10 depicts a support and stabilization base and drink carrier in accordance with one or more embodiments of the present disclosure.

While shown as a flexible shopping bag in the embodiment of FIG. 1, the receptacle 110 may be any type of container, holder, vessel, repository, box, tray, or the like that is designed to carry, hold, or transport items. FIG. 10 depicts a drink carrier 130 as one embodiment of a receptacle 110. Something like a food tray may also serve as one embodiment of a receptacle 110.

The receptacle 110 may be constructed of an entirely flexible material as with the flexible shopping bag or may be constructed of a durable and sturdy material or even a durable but deformable material as with the drink carrier or even with a hard non-pliable material as with the food tray. The receptacle 110 is configured to hold, carry, or transport items. The support and stabilization base 120 may also support another item that is not a receptacle as defined herein.

At times, the carrier device 100 will need to be set down on a surface that may not provide adequate stability to the items within the receptacle 110. The instability may be because of the softness of the surface, the slope of the surface, irregular contours of the surface, or for other similar reasons. As an illustrative example, the carrier device may be transporting food items or drinks for delivery to a customer and the surface is a passenger seat of a vehicle. The seat may be designed to slope back or may include contours designed for a human body that are not ideal for the food items that need to remain upright. Conventional bags may not have the features and capabilities to adjust to the slope or irregular contours.

The carrier device 100 is designed to adjust to the surface and keep the items in the carrier device 100 level and upright. The carrier device 100 includes a base 120. Although shown and described with certain components and functionality, other embodiments the base 120 may include fewer or more components to implement less or more functionality.

The base 120 is designed and configured to provide stability to the receptacle 110 (and thereby the items within the receptacle 110) no matter the surface on which the carrier device 100 is placed. The base is designed and configured to keep the receptacle 110 and the items within upright.

The base 120, in some embodiments, includes a casing or outer casing 122. The outer casing 122 is configured to be pliable, malleable, or flexible. The outer casing 122 may be made out of any material that exhibits such pliable characteristics and may include, but is not limited to, fabrics, plastics, leathers, or other similar materials.

The outer casing 122 is configured to enclose or encase a compartment 124 within the outer casing 122. The outer casing 122 may include a plurality of granules or pellets or spheroids or ovoid-shaped granular stuffing within the compartment 124. For simplicity, these are referred to as pellets or granules 126 herein, however, the pellets 126 may be of any shape and size that allows for the pellets 126 to shift and move relative to each other within the compartment 124. Other shapes contemplated herein may include spherical, cylindrical, globular, or other shapes that allow for the shifting and movement of the pellets 126 within the compartment 124.

While described as granules or pellets, in other embodiments, the outer casing 122 may enclose a gel or gel-like substance with a viscosity greater than water allowing the gel-like substance to move and flow within the outer casing 122 at an appropriate rate to provide the function similar to the granules or pellets. Also contemplated are viscoplastic materials, such as Bingham plastics, or sand or other substances that behave as a more rigid body at low stresses but flow at high stresses. Taken all together these various embodiments are encompassed within the term flowing substance. The flowing substance will act like a fluid (whether with relatively larger granules or imperceptibly small particles such as within a gel-like substance). The flowing substance deforms is subjected to an external force, especially shear forces.

In some embodiments, the casing 120 is made of a material that has a relatively high coefficient of friction. As the surface on which the carrier device 100 is set may be sloped, the casing 120 may provide sufficient friction to make it so the carrier device does not slide down the slope of the surface. In embodiments where the base and the casing are lined within the receptacle (e.g., at the bottom of the receptacle within the cavity), the casing 120 may provide sufficient friction to the items within the receptacle 110 to make it so the items do not slide within receptacle 110.

The outer casing 122 is configured to retain the pellets 126 within the compartment 124 and shift the overall shape of the base 120 to suit the particular conditions of the carrier device 100 including the items within the carrier device 100 and the surface on which it is placed.

In addition, the base 120 is configured to provide a weighted stability to the carrier device 100. This may be accomplished by utilizing a material for the pellets 126 that includes enough mass or weight to provide stability to a tall bag no matter the items that are placed within the receptacle 110.

The compartment 124 may be a separate pouch or bag within the outer casing or the compartment 124 may refer to the space within the outer casing or formed between the outer casing and a rigid board.

The base 120 may, in some embodiments, be incorporated to the receptacle such that the base 120 and the receptacle 110 are one homogeneous piece. In some embodiments, the base 120 is a separate piece apart from the receptacle 110. In some embodiments, the base is coupled or attached to the receptacle. In some embodiments, the base 120 is sewn into the receptacle 110, either on the inside of the receptacle 110 or on the outside and bottom of the receptacle 110.

In some embodiments, the base 120 is attached to the receptacle 110 through an adhesive. In some embodiments, the base 120 is attached to the receptacle 110 by staples, fasteners, rivets, Velcro, or other similar manners. Other manners of attachment, known to those skilled in the art, are contemplated herein.

In some embodiments, the base 120 forms or covers a substantial majority or the entirety of the bottom surface of the receptacle 110, allowing the pellets to cover the entirety or a substantial portion of the bottom of the receptacle 110. In some embodiments, the base 120 forms the bottom of the receptacle 110.

The overall shape of the outer casing 122 and therefore the base 120 may be designed to allow for maximum balance of the carrier device 100. The outer casing 122 will have a sufficient quantity of pellets 126 to allow for them to move around and adjust within the outer casing 122 or shift to one side but still have enough on an opposite side of the compartment 124, for example, to retain the balance, weight, stability to keep the receptacle 110 upright. In addition, the base 120 is designed to allow the items within the receptacle 110 to settle and remain upright, allowing the casing to conform to the shape of the bottom of the items.

In some embodiments, the base 120 is attached or coupled to an existing bag or receptacle 110, allowing for the base 120 to be used with various receptacles 110 as needed.

Referring to another embodiment of a carrier device 100 in accordance with one or more embodiments of the invention, the carrier device 100 may have base 120 attached to a cloth bag or receptacle 110. The bag may be an otherwise standard shopping bag with a cloth bottom that typically would make it difficult for the bag to remain upright when set down.

The base 120 is attached to the receptacle 110, utilizing adhesive tape, but may be attached in whatever manner necessary to couple the base 120 to the receptacle 110. The base 120 covers the entirety of the bottom of the receptacle 110. In some embodiments, the base 120 may be larger than the bottom of the receptacle 110. In other embodiments, the base 120 may be smaller than the bottom of the receptacle 110. The base 120 further includes features that allow it to be stable and not slide on surfaces. The base 120 includes a pliable plastic casing that encases the pellets or granules within the compartment within the casing. If the base were to be put on its side, the majority of the pellets or granules will slide down the compartment within the casing but the casing in embodiments will have retained a general overall shape and continue to cover the entirety of the bottom of the bag.

Referring now to another embodiment, a base 120 in accordance with one or more embodiments of the invention includes a casing that is sewn together to form a compartment within. The general shape of the base 120 may designed to match the general shape of the bottom of the receptacle 110 or other object. The base 120 has an ability to deform slightly and be pliable. The base may be designed to be pliable on both sides of the base or in some case, may be pliable on only one side of the base 120. The base 120 can be attached or coupled to the receptacle 110 as needed in some implementations. In some embodiments, the base 120 may simple be placed within the receptacle 110, resting at the bottom of the receptacle 110 and substantially covering or completely covering the bottom surface of the receptacle 110.

Referring to another embodiment a drink carrier may be used with a base 120 in accordance with one or more embodiments of the invention. The drink carrier will settle into the base 120 and the base would allow the drink carrier to remain upright and not move as the weight of the drinks would force the drink carrier to settle and stay in a stable position with proper balance.

Figure 3:
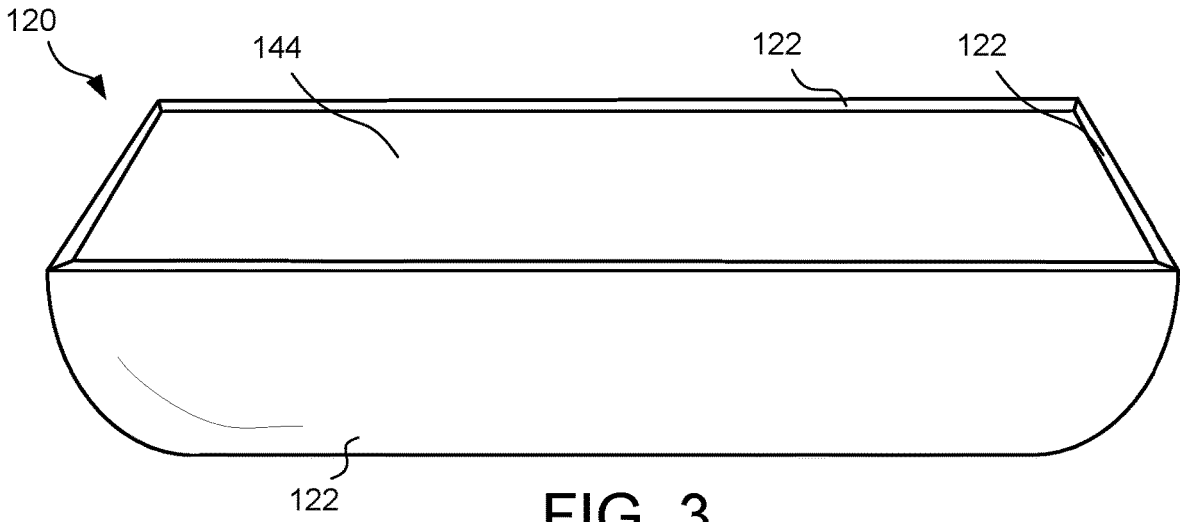
FIG. 3 depicts a front elevation view illustrating a support and stabilization base in accordance with one or more embodiments of the present disclosure.

FIG. 3 depicts a front elevation view illustrating a support and stabilization base 120 in accordance with one or more embodiments of the present disclosure. Although shown and described with certain components and functionality, other embodiments the support and stabilization base 120 may include fewer or more components to implement less or more functionality.

The support and stabilization base 120 includes an outer casing 122 that envelopes the bottom portion of the support and stabilization base 120 and extends up to a top surface of the support and stabilization base 120. As shown, the outer casing 122 extends to the top surface of the support and stabilization base 120 and covers the perimeter of the top surface of the support and stabilization base 120. The top surface of the support and stabilization base 120 is formed by a rigid and sturdy rectangular board (referred to, herein, as a rigid board 144). The rigid board 144 forms a top surface that is substantially rigid and flat. This surface allows for objects and other things to be set upon a flat surface.

The bottom of the support and stabilization base 120 is generally pliable and deformable. The bottom of the support and stabilization base 120 is configured to deform and conform to irregular surfaces and sloped surfaces. The bottom of the support and stabilization base 120 will change shape and allow the top surface to remain level and flat. Of course, uses may dictate that a non-level surface is wanted and the support and stabilization base 120 may also allow the top surface to be sloped in any way desirable. A feature of the support and stabilization base 120 allows for the top flat surface of the support and stabilization base 120 to not need to be correlated to the surface that the support and stabilization base 120 sits upon.

Figure 4:
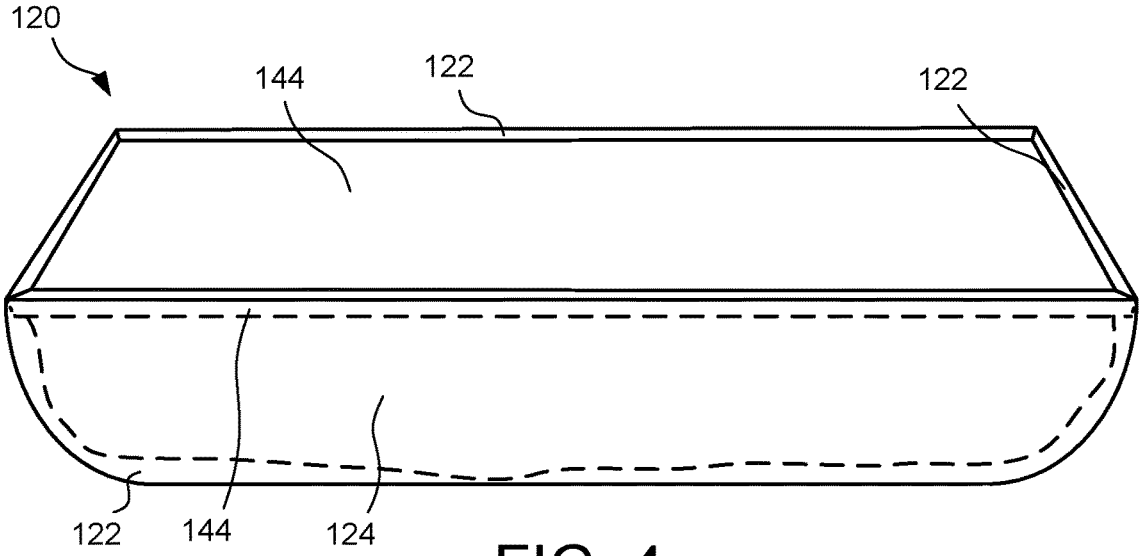
FIG. 4 depicts a front elevation view illustrating a support and stabilization base showing some internal components in accordance with one or more embodiments of the present disclosure.

FIG. 4 depicts a front elevation view illustrating a support and stabilization base 120 showing some internal components in accordance with one or more embodiments of the present disclosure. Although shown and described with certain components and functionality, other embodiments the support and stabilization base 120 may include fewer or more components to implement less or more functionality.

As shown, the support and stabilization base 120 includes a rigid board 144 that forms the top surface of the support and stabilization base 120. As can be seen, the rigid board 144 is a thin board with a thickness large enough to make the board rigid or sturdy to hold items. Just below the rigid board 144 but within the outer casing 122 is a compartment 124 that fills the majority of the space within the outer casing 122. The compartment 124 may be a bag or pouch that houses a deformable substance or granules (see FIG. 5). In some embodiments, the deformable substance or granules are merely within the outer casing 122 and the rigid board 144. In some embodiments, there is a pouch or bag that form the compartment 124.

Figure 5:
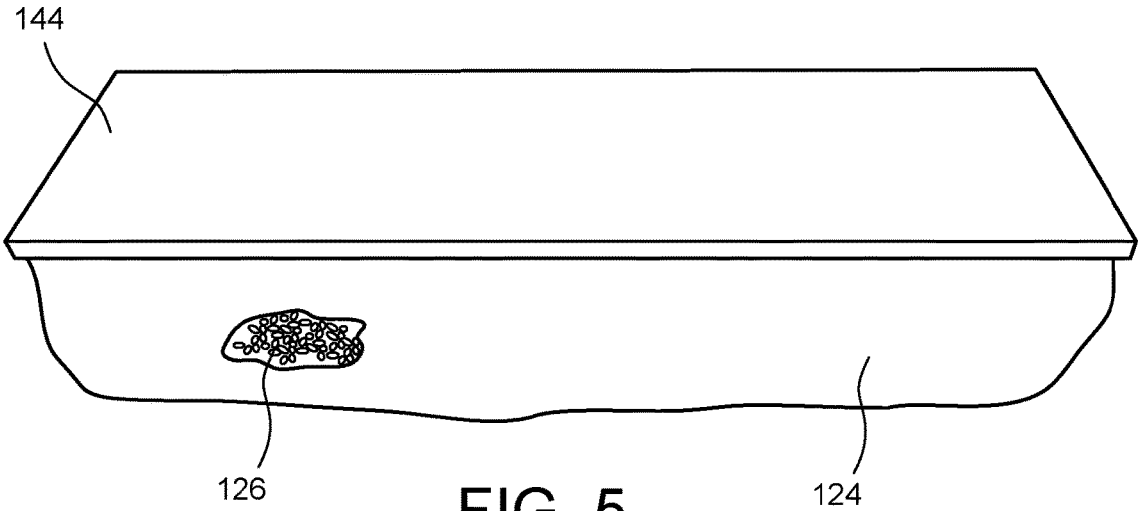
FIG. 5 depicts a front elevation view illustrating the support and stabilization base with the outer casing removed in accordance with one or more embodiments of the present disclosure.

FIG. 5 depicts a front elevation view illustrating the support and stabilization base 120 with the outer casing removed in accordance with one or more embodiments of the present disclosure. Although shown and described with certain components and functionality, other embodiments the support and stabilization base 120 may include fewer or more components to implement less or more functionality.

With the outer casing 122 removed, FIG. 5 shows the compartment 124 which is a bag or pouch that houses a plurality of granules 126 within the bag or pouch. The pouch is, in some embodiments, adhered to the rigid board 144. In some embodiments, the pouch is adhered to the rigid board 144 so as to form a compartment with the rigid board forming the top of the compartment. Although illustrated with granules 126, the granules may be a liquid or gel-like substance that fills an entirety or a portion of the compartment and is deformable. The deformability of the granules 126 allows for the support and stabilization base 120 to deform and conform to any irregular surface. The outer casing 122 in many embodiments is a fabric or a non-rigid plastic.

In some embodiments, the board 144 is not rigid. In some embodiments, the board 144 is merely less pliable and deformable than the bottom of the support and stabilization base 120. In some embodiments, the board 144 has the same deformability as the bottom of the support and stabilization base 120.

Figure 6:
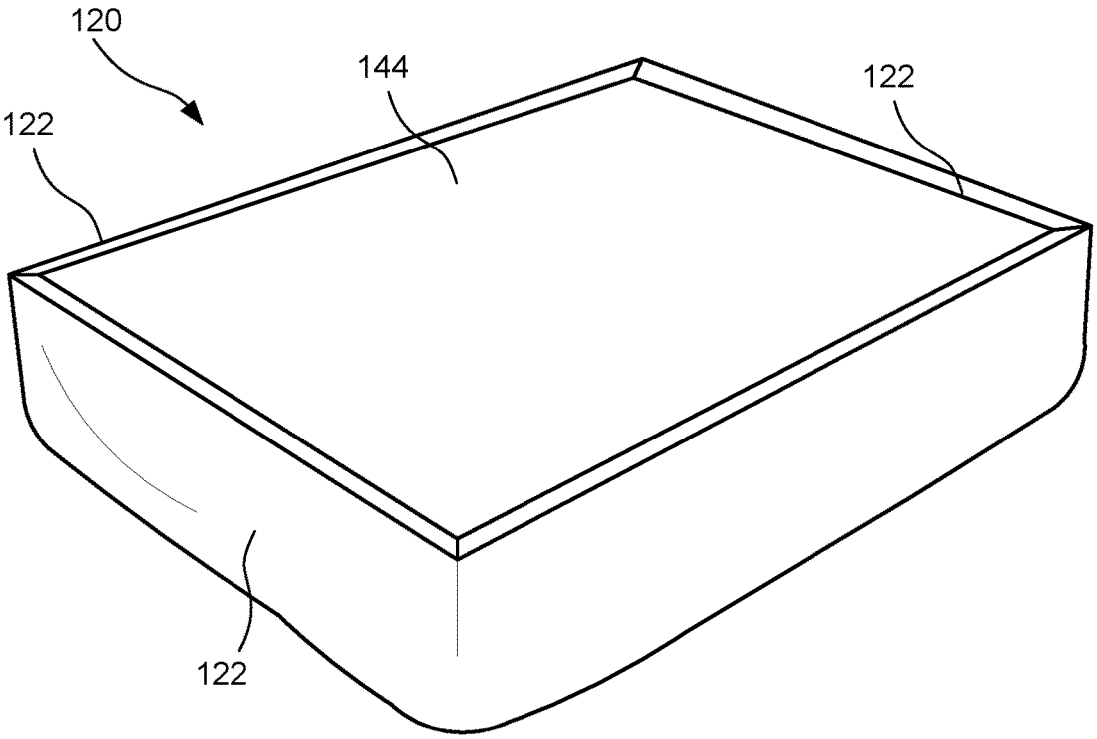
FIG. 6 depicts an isometric view illustrating the support and stabilization base in accordance with one or more embodiments of the present disclosure.

FIG. 6 depicts an isometric view illustrating the support and stabilization base in accordance with one or more embodiments of the present disclosure. Although shown and described with certain components and functionality, other embodiments the support and stabilization base 120 may include fewer or more components to implement less or more functionality.

FIG. 6 shows a different view to show how the edges of the outer casing 122 come up and adhere to a top of the rigid board 144 forming a perimeter around the rigid board 144. This may be done through an adhesive or other mechanical attachments that secures and couples the outer casing 122 to the rigid board 144. In some embodiments, the outer casing 122 is adhered to the sides of the rigid board 144. This may depend on how thick the rigid board 144 is and the available side surface and whether the outer casing 122 can be adhered to those surfaces.

Figure 7:
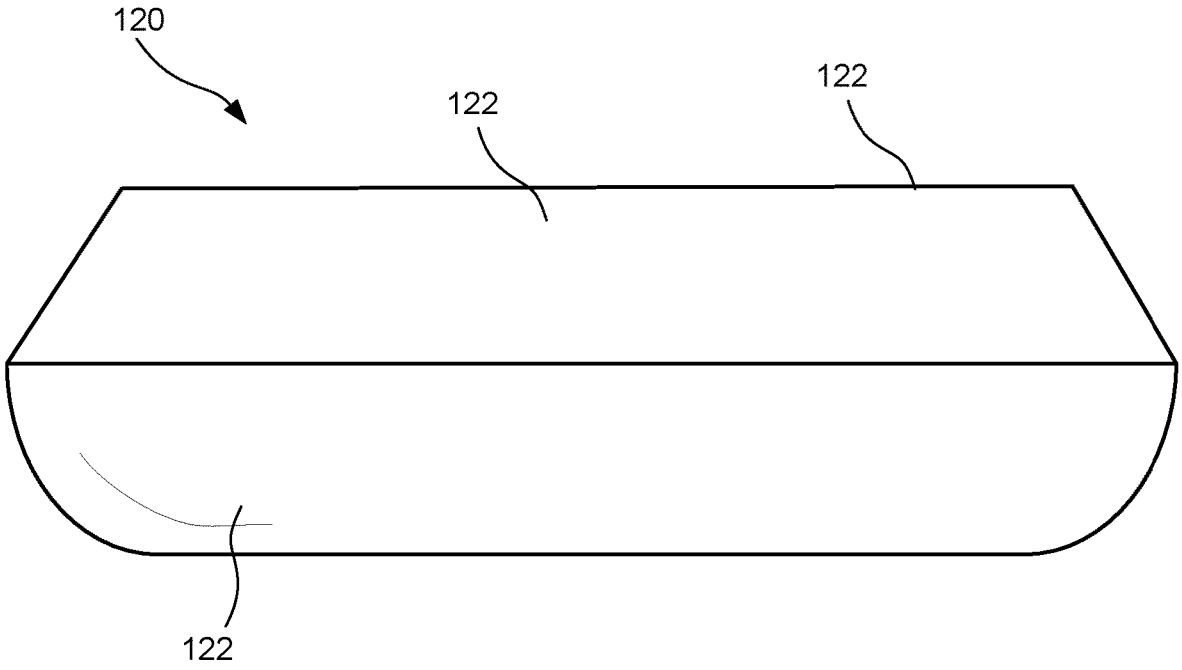
FIG. 7 depicts a front elevation view illustrating a support and stabilization base in accordance with one or more embodiments of the present disclosure.
Figure 8:
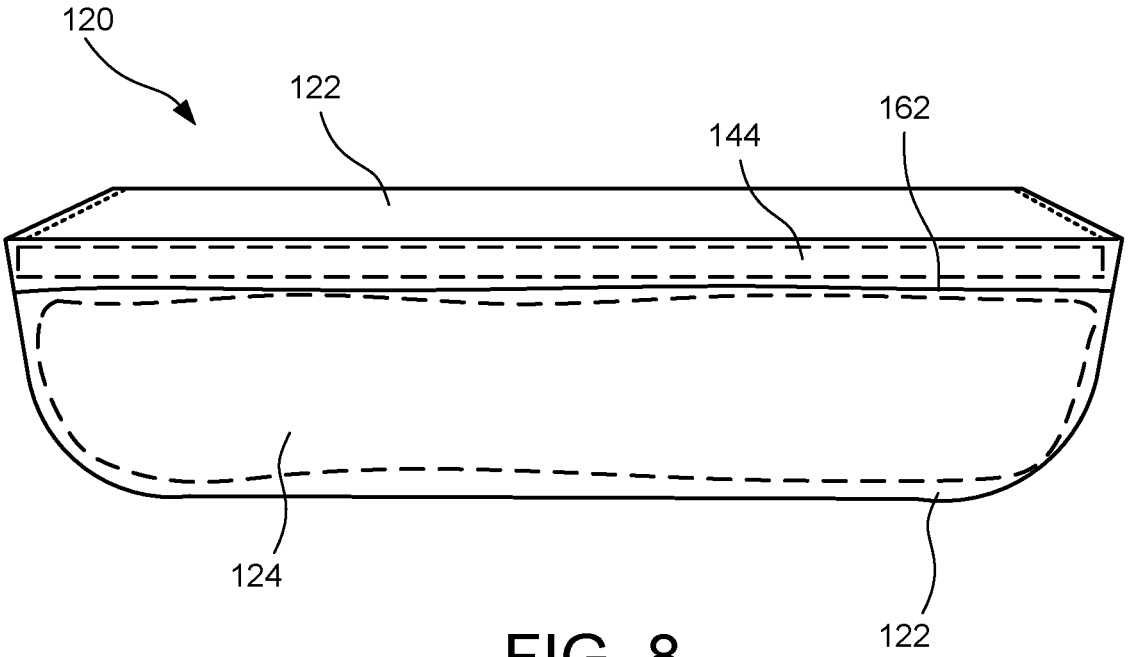
FIG. 8 depicts a front elevation view illustrating a support and stabilization base showing the internal components in accordance with one or more embodiments of the present disclosure.
Figure 9:
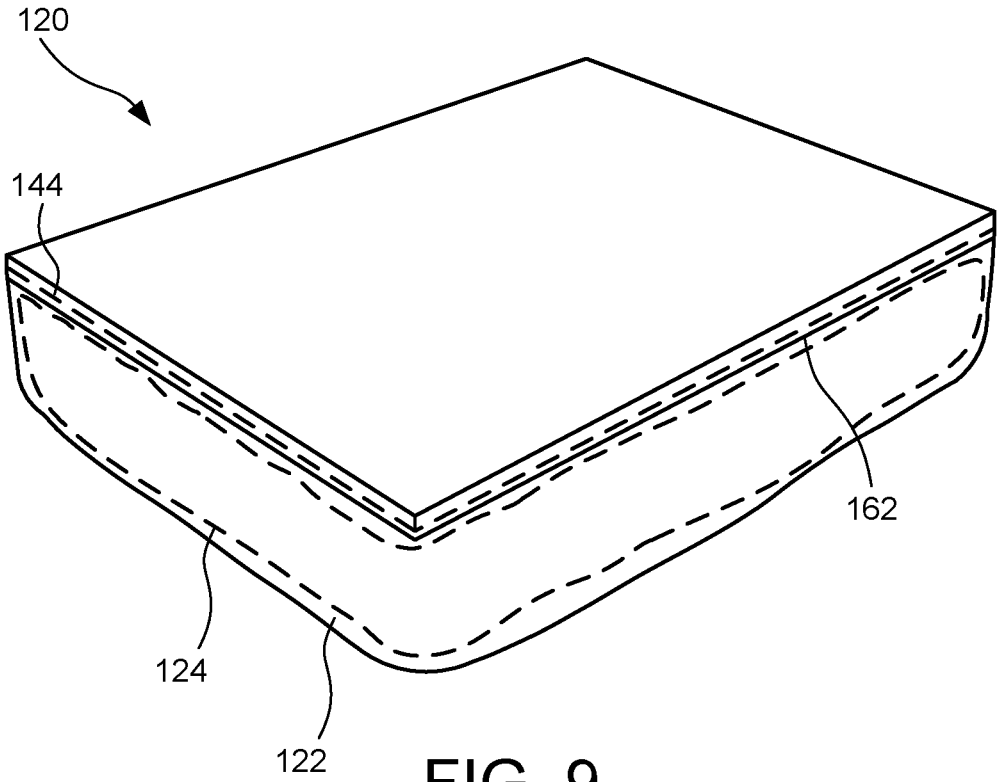
FIG. 9 depicts an isometric view illustrating the support and stabilization base showing the internal components in accordance with one or more embodiments of the present disclosure.

Referring to FIGS. 7-9, another embodiment of the support and stabilization base 120 is shown to illustrate variations of the support and stabilization base 120 that are within the same inventive concept of the support and stabilization base 120.

FIG. 7 depicts a front elevation view illustrating a support and stabilization base in accordance with one or more embodiments of the present disclosure. Although shown and described with certain components and functionality, other embodiments the support and stabilization base 120 may include fewer or more components to implement less or more functionality.

In FIG. 7, the outer casing 122 completely envelopes the internal components. The outer casing 122 extends over the top of the rigid board 144 (not visible) such that rigid board 144 is now completely internal to the outer casing 122.

FIG. 8 depicts a front elevation view illustrating a support and stabilization base showing the internal components in accordance with one or more embodiments of the present disclosure. Although shown and described with certain components and functionality, other embodiments the support and stabilization base 120 may include fewer or more components to implement less or more functionality.

In FIG. 8, some of the internal components of the support and stabilization base 120 are shown. The internal components include a compartment 124 and the rigid board 144. The rigid board 144 and the compartment 124 are separated by a liner 162. The liner 162 may be a fabric or non-rigid plastic that merely separates the compartment from the rigid board 144. In some embodiments, the liner 162 and the outer casing 122 form the compartment. In other embodiments, there is a bag or pouch within the compartment 124.

In some embodiments, the liner 162 is securely coupled to the outer casing 122. The liner 162 will effectively create two compartments within the outer casing 122, one compartment for the rigid board 144 and another compartment for the pouch or bag or alternatively, directly for the granules or gel-like substance.

The rigid board 144 may be securely coupled to the outer casing 122 and the liner 162. The rigid board 144 may not have room to move around within the outer casing 122 and the liner 162.

FIG. 9 depicts an isometric view illustrating the support and stabilization base showing the internal components in accordance with one or more embodiments of the present disclosure. Although shown and described with certain components and functionality, other embodiments the support and stabilization base 120 may include fewer or more components to implement less or more functionality.

FIG. 9 depicts another view of the support and stabilization base 120. The embodiments have generally been shown as generally rectangular in shape. However, the rigid board 144 can obviously be made to any shape or size with the outer casing and the bottom of the support and stabilization base 120 deformable. This allows for construction of a support and stabilization base of any size or shape in different embodiments of the invention.

FIG. 10 depicts a support and stabilization base and drink carrier in accordance with one or more embodiments of the present disclosure. Although shown and described with certain components and functionality, other embodiments the support and stabilization base 120 may include fewer or more components to implement less or more functionality.

FIG. 10 illustrates a variation of the support and stabilization base 120. The support and stabilization base 120 is utilized in this example with a drink carrier 130 that is carrying drinks 132. The support and stabilization base 120 is similar to the support and stabilization bases described above, only without a rigid board. The top surface of the support and stabilization base 120 is therefore also deformable which allows for each of the bottom surfaces of the drink carrier 130 to push into the support and stabilization base 120 and be more supportable the drink carrier 130. With the top surface of the support and stabilization base deformable, the support and stabilization base will create stability for the drink carrier.

In some embodiments, a support and stabilization base includes an outer casing, a compartment within the outer casing, and a flowing substance within the compartment. The outer casing is constructed of a pliable material or combination of materials. The bottom of the outer casing is configured to conform to a surface. In some embodiments, the flowing substance is a plurality of granules.

In some embodiments, the base further includes a receptacle. In some embodiments, the receptacle is coupled to the outer casing. In some embodiments, the receptacle is configured to hold at least one object within the receptacle.

In some embodiments, the outer casing is coupled to an inside of the receptacle.

In some embodiments, the outer casing is coupled to a bottom surface of the receptacle.

In some embodiments, the receptacle is one of a flexible bag, a drink carrier, or a tray.

In some embodiments, the outer casing is further configured to conform on a bottom of the outer casing to a surface on which the base may rest.

In some embodiments, the flowing substance is one of granules, ovoid-shaped granular stuffing, a gel substance, or sand, or other fluid-like fillings that deform when acted upon by an external force. In some embodiments, the granules include ovoid-shaped granular stuffing.

In some embodiments, the granules include pellets of a hard material and are configured to shift and move relative to each other.

In some embodiments, the granules include viscoplastic materials.

In some embodiments, the base further includes a rigid board within a second compartment of the outer casing.

In some embodiments, the surface is an uneven surface.

In some embodiments, a support and stabilization base includes a plurality of granules housed within a bag, a rigid board, and an outer casing. The bag and the rigid board are housed within the outer casing. The bag and the rigid board are separated by a fabric liner within the outer casing. The rigid board is positioned at a top of the outer casing and above the bag which is position at a bottom of the outer casing. The outer casing is constructed of a pliable material. A top of the base is substantially flat and a bottom of the base is pliable and configured to conform to an uneven surface.

In some embodiments, the base further includes a receptacle. In some embodiments, the receptacle is coupled to the outer casing. In some embodiments, the receptacle is configured to hold at least one object within the receptacle.

In some embodiments, the outer casing is lined within an inside of the receptacle.

In some embodiments, the outer casing is coupled to a bottom surface of the receptacle.

In some embodiments, the bag is a PVC bag.

In some embodiments, the receptacle is one of a flexible bag, a drink carrier, or a tray.

In some embodiments, the granules include ovoid-shaped granular stuffing.

In some embodiments, the granules include pellets of a hard material and are configured to shift and move relative to each other.

In some embodiments, the granules include viscoplastic materials.

Embodiments of apparatuses and devices are described herein that may include on some of the features and components of the embodiments described. Additionally, methods of using and making the apparatuses and devices described herein are contemplated.

Although the foregoing disclosure provides many specifics, these should not be construed as limiting the scope of any of the ensuing claims. Other embodiments may be devised which do not depart from the scopes of the claims. Features from different embodiments may be employed in combination. The scope of each claim is, therefore, indicated and limited only by its plain language and the full scope of available legal equivalents to its elements.

Reference throughout this specification to features, advantages, or similar language does not imply that all of the features and advantages that may be realized with the subject matter of the present disclosure should be or are in any single embodiment. Rather, language referring to the features and advantages is understood to mean that a specific feature, advantage, or characteristic described in connection with an embodiment is included in at least one embodiment of the present disclosure. Thus, discussion of the features and advantages, and similar language, throughout this specification may, but do not necessarily, refer to the same embodiment.

In the above description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

The present subject matter may be embodied in other specific forms without departing from its spirit or essential characteristics. The described embodiments are to be considered in all respects only as illustrative and not restrictive.

In the above description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A support and stabilization base, the base comprising:

an outer casing;

a first compartment and a second compartment within the outer casing, wherein the first compartment and the second compartment are separated by a liner;

a rigid board, wherein the second compartment completely encloses the rigid board, and wherein the rigid board extends to a perimeter edge of the outer casing;

a flowing substance within the first compartment, wherein the flowing substance deforms when acted upon by an external force, wherein the outer casing is constructed of a pliable material or combination of materials and wherein a bottom of the outer casing is configured to conform to a surface; and a receptacle, wherein the receptacle is a shopping bag comprising sidewalls of a flexible material wherein the flexible material laterally encloses a space and leaves an opening at a top of the shopping bag and wherein the receptacle is coupled to a top of the outer casing with the outer casing coupled to an outside of the shopping bag at a bottom of the shopping bag opposite the opening and such that rigid board is below the top of the outer casing which is below the shopping bag, and wherein the rigid board is separate from the shopping bag and receptacle, and wherein at the top of the shopping bag a rim of the shopping bag is flexible and not rigid and further comprises a handle extending from the flexible rim and wherein the outer casing is sewn to the receptacle and wherein the receptacle comprises the space with a volume greater than a volume of the flowing substance and wherein the flowing substance is configured to provide a weighted stability to the shopping bag to keep the shopping bag upright.

2. The support and stabilization base of claim 1, wherein the outer casing is further configured to conform on a bottom of the outer casing to a surface on which the base may rest.

3. The support and stabilization base of claim 1, wherein the flowing substance is one of granules, ovoid-shaped granular stuffing, a gel substance, or sand.

4. The support and stabilization base of claim 1, wherein the flowing substance is granules, wherein the granules comprise pellets of a hard material and are configured to shift and move relative to each other.

5. The support and stabilization base of claim 1, wherein the flowing substance comprise viscoplastic materials.

6. The support and stabilization base of claim 1, wherein the surface is an uneven surface.

7. A support and stabilization base, the base comprising:

a flowing substance housed within a bag;

a rigid board;

an outer casing, wherein the bag is housed within a first compartment of the outer casing and wherein the rigid board is housed within a second compartment of the outer casing with a liner separating the first and second compartments, and wherein the rigid board extends to a perimeter edge of the outer casing; and a receptacle, wherein the receptacle is a shopping bag comprising sidewalls of a flexible material wherein the flexible material laterally encloses a space without rigid walls and leaves an opening at a top of the shopping bag and wherein the receptacle comprises a volume greater than a volume of flowing substance and wherein at the top of the shopping bag a rim of the shopping bag is flexible and not rigid and further comprises a strap handle extending from the rim and wherein the outer casing is sewn to the receptacle and wherein the flowing substance is configured to provide a weighted stability to the shopping bag to keep the shopping bag upright, wherein the rigid board is positioned at a top of the outer casing and above the bag which is position at a bottom of the outer casing and such that rigid board is below the top of the outer casing which is below the receptacle, and wherein the rigid board is separate from the receptacle, and wherein the outer casing is constructed of a pliable material, and wherein a top of the base is substantially flat and a bottom of the base is pliable and configured to conform to an uneven surface.

8. The support and stabilization base of claim 7, wherein the flowing substance comprises granules, wherein the granules comprise ovoid-shaped granular stuffing.

9. The support and stabilization base of claim 7, wherein the flowing substance comprises granules, wherein the granules comprise pellets of a hard material and are configured to shift and move relative to each other.

10. The support and stabilization base of claim 7, wherein the flowing substance is one of granules, ovoid-shaped granular stuffing, a gel substance, or sand.

* * * * *